US005852913A

United States Patent [19]

Tuckner et al.

[11] Patent Number: 5,852,913

[45] Date of Patent: Dec. 29, 1998

[54] ORIENTATIONALLY SENSITIVE CLOSURE AND ORIENTING APPARATUS THEREFOR

[75] Inventors: Ronald F. Tuckner, White Bear Lake; Glen John Peterson, Eagan, both of Minn.

[73] Assignee: Tetra Laval Holdings & Finance, SA, Pully, Switzerland

[21] Appl. No.: 812,319

[22] Filed: Mar. 5, 1997

[51] Int. Cl.[6] ..... B65B 7/28; B67B 3/28

[52] U.S. Cl. ..... 53/367; 53/133.2; 493/87

[58] Field of Search ..... 53/133.2, 133.1, 53/367, 420, 410; 493/87

[56] References Cited

U.S. PATENT DOCUMENTS

| | | | |
|---|---|---|---|
| 1,958,306 | 5/1934 | La Bombard et al. | 226/92 |
| 2,647,672 | 8/1953 | Burnell | 226/81 |
| 2,914,901 | 12/1959 | Kinsley, Jr. et al | 53/310 |
| 3,021,938 | 2/1962 | Cadwallader | 198/33 |
| 3,054,240 | 9/1962 | Dimond | 53/308 |
| 3,109,530 | 11/1963 | McPherson | 198/33 |
| 3,882,660 | 5/1975 | Sterling | 53/308 |
| 4,354,588 | 10/1982 | Wolfertz | 198/394 |
| 4,653,676 | 3/1987 | Stull | 222/566 |
| 4,664,248 | 5/1987 | Goodman, Jr. et al. | 198/394 |
| 4,696,143 | 9/1987 | Young | 53/367 X |
| 5,063,725 | 11/1991 | Kent et al. | 53/367 X |
| 5,095,681 | 3/1992 | Choi | 53/306 |
| 5,150,559 | 9/1992 | Winfield | 53/367 X |
| 5,159,797 | 11/1992 | Herzog | 53/312 |
| 5,207,048 | 5/1993 | Wysocki | 53/133.2 |
| 5,335,474 | 8/1994 | Rüetschi et al. | 53/282 |
| 5,396,979 | 3/1995 | Wysocki | 198/392 |
| 5,398,485 | 3/1995 | Osifchin | 53/490 |
| 5,435,112 | 7/1995 | Goyet | 53/467 |
| 5,498,152 | 3/1996 | Unterlander et al. | 425/534 |

*Primary Examiner*—James F. Coan
*Attorney, Agent, or Firm*—Michael A. Catania

[57] ABSTRACT

An orientationally sensitive closure for mounting to a container in a specific orientation includes a closure body and a flange. A spout portion extends from one side of the flange and an orienting projection extends from a side of the flange opposite of the spout. The flange and spout can be coaxial with one another, with the spout centrally disposed thereon. The projection extends from the flange in a non-coaxial relation to the spout and flange. An apparatus for orienting the closure prior to mounting to a container includes a body defining inlet and outlet regions extending along a longitudinal axis of the body. Flange and projection receiving channels extend between the inlet and outlet regions. The flange channel defines a substantially straight-through path through the apparatus, along the longitudinal axis. The projection channel defines a path having at least two bends therein defining a portion generally transverse to the longitudinal axis. The closure rotates as it traverses through the apparatus to orient the closure so that a trailing edge of the closure adjacent the projection is last discharged from the apparatus.

15 Claims, 13 Drawing Sheets

ORIENTATIONALLY SENSITIVE CLOSURE AND ORIENTING APPARATUS THEREFOR

FIELD OF THE INVENTION

This invention relates to orientationally sensitive closures and an apparatus for orienting such closures for mounting to containers. More particularly, the invention relates to closures having a specifically oriented direction for mounting to a container and an apparatus for orienting such closures prior to mounting to the container.

BACKGROUND OF THE INVENTION

Containers having spout-like closures for dispensing the contents therefrom have come into widespread use. One such type of closure includes a threaded spout extending upwardly from the container or carton. The closure is used with a cap that threadedly engages the spout. Typically, such closures are injection molded directly onto the container material stock. Such closures may, however, be formed separate from the container and subsequently mounted thereto. For certain applications, such closures have shown significant advantages over known closure systems.

Another known type of closure includes a one-piece molded body having a hinged cap. Such one piece closures advantageously eliminate the need for a separately formed closure cap. The one-piece configuration eliminates the possibility of losing or inadvertently discarding the separate cap portion.

One drawback to using such hinged closures is that each closure must be properly oriented on its respective container, because each closure cover hinges or pivots about an axis particularly located on the closure. For example, the cover portion of a hinged closure that is mounted to a gable top carton must pivot upwardly, out of the way of the contents being dispensed or poured from the container. If the cover pivots in a manner or direction other than upwardly, it can interfere with dispensing or pouring the contents therefrom.

In another application, it may be desired to position a non-hinged closure, such as a threaded closure package, in a particular orientation on a container. Such particularized orientation of the closure can be, for example, to effect the proper positioning of indicia on the closure or closure cap relative to the container. This can be significant if the indicia contains a logo, trademark or like representation.

Known orientable closures typically have one or more flattened sides to facilitate proper orientation of the closure on the container. Inasmuch as such partially flattened closures are acceptable for hinged type closures, there are a number of drawbacks. First, such flattened sides can increase the cost to manufacture such closures. In addition, handling and positioning of such closures could require additional capital equipment for sorting, positioning and mounting the closures to containers. Moreover, such flattened closures are difficult to use in conjunction with a threaded-type closure arrangement.

Accordingly, there continues to be a need for an orientationally sensitive closure and an orienting apparatus for use with such a closure. Such a closure and apparatus readily orients the closure for proper positioning for mounting to a container. Such a closure that includes a hinged cover portion is properly positioned for mounting to a container so that the cover hinges or pivots, for example, away from the dispensing direction. Advantageously, such a closure can include directionally sensitive indicia, such as logos and the like, which indicia is properly oriented on the closure.

SUMMARY OF THE INVENTION

An orientationally sensitive closure adapted for mounting to a container in a specific orientation or direction includes a closure body and a mounting flange. A spout extends from one side of the flange, positioned centrally on, and generally coaxially with the flange. An orienting projection extends from an opposite side of the flange, in a non-coaxial relation to the spout and flange.

The closure can be an orientationally sensitive, hinged-type closure. In such a closure arrangement, the closure must be mounted to the container such that the cover hinges, for example, away from the flow of dispensed material from the container. The closure can also contain directionally or orientationally sensitive indicia, such as logos, trademarks and the like, which must be properly oriented on, for example, a threaded closure cap.

In a preferred embodiment, the orientationally sensitive closure has circular spout and flange portions. The projection can be formed as a relatively short barrel-like element having a circular cross-section. That portion of the closure flange periphery closest to the projection defines a trailing edge of the closure. Conversely, that portion of the flange periphery that is 180° from the trailing edge defines the leading edge of the closure.

An apparatus for orienting the closure prior to mounting the closure to a container includes a body portion having a closure inlet region and a closure outlet region that extend along a longitudinal axis of the apparatus body. The body defines a longitudinally oriented flange receiving channel having a width configured to slidingly receive the closure flange, and a projection receiving channel extending generally longitudinally along the body portion. The projection receiving channel has a width configured to slidingly receive the closure orienting projection. The projection receiving channel has at least two bends therein, such that a closure, positioned at the inlet and traversing through the apparatus, is rotationally oriented by interaction of the projection and the projection channel to discharge the closure by the leading edge first, i.e., the leading edge in a leading position.

The apparatus can include a longitudinally oriented spout receiving channel adjacent to the flange channel. Preferably, the flange and spout channels have substantially constant widths and substantially constant cross-sectional areas. The projection channel can taper inwardly to facilitate orienting the closure and to facilitate rotation of the closure to further proper orientation. In one embodiment, the projection receiving channel has three bends and is configured to discharge the closures therefrom in a path generally parallel to the longitudinal axis of the apparatus body.

An alternate embodiment of the orienting apparatus includes a cylinder positioned on the body in the path of the flange channel. The cylinder rotates about an axis that intersects the projection channel. The cylinder is configured to receive the closures, at about the spout, and rotate 180° to carry the closures from the inlet region to the outlet region.

Preferably, the cylinder has a pair of cradle regions symmetrically positioned about the axis and extending inwardly from a periphery of the cylinder. The cradles are configured having a semi-circular shape to carry the closures at about the spout. In a most preferred embodiment, the projection channel has two branches, a straight-through branch that intersects the axis and an outwardly, arcuately extending branch that transitions to and is contiguous with an inwardly, arcuately extending path. The arcuate path diverges from the straight-through path at about the inlet region and conjoins with the straight-through path at about the outlet region.

The cylinder is configured to move the closures from the inlet to the outlet by rotation of the cylinder, and is configured to orient the closures through rotation of the closures relative to the cylinder, by interaction between the projection and the arcuate projection channel branch, so that the closure is discharged from the apparatus with the leading edge in a leading position.

Other features and advantages of the present invention will be apparent from the following detailed description, the accompanying drawings, and the appended claims.

DETAILED DESCRIPTION OF THE PREFERRED EMBODIMENTS

Figure 1:
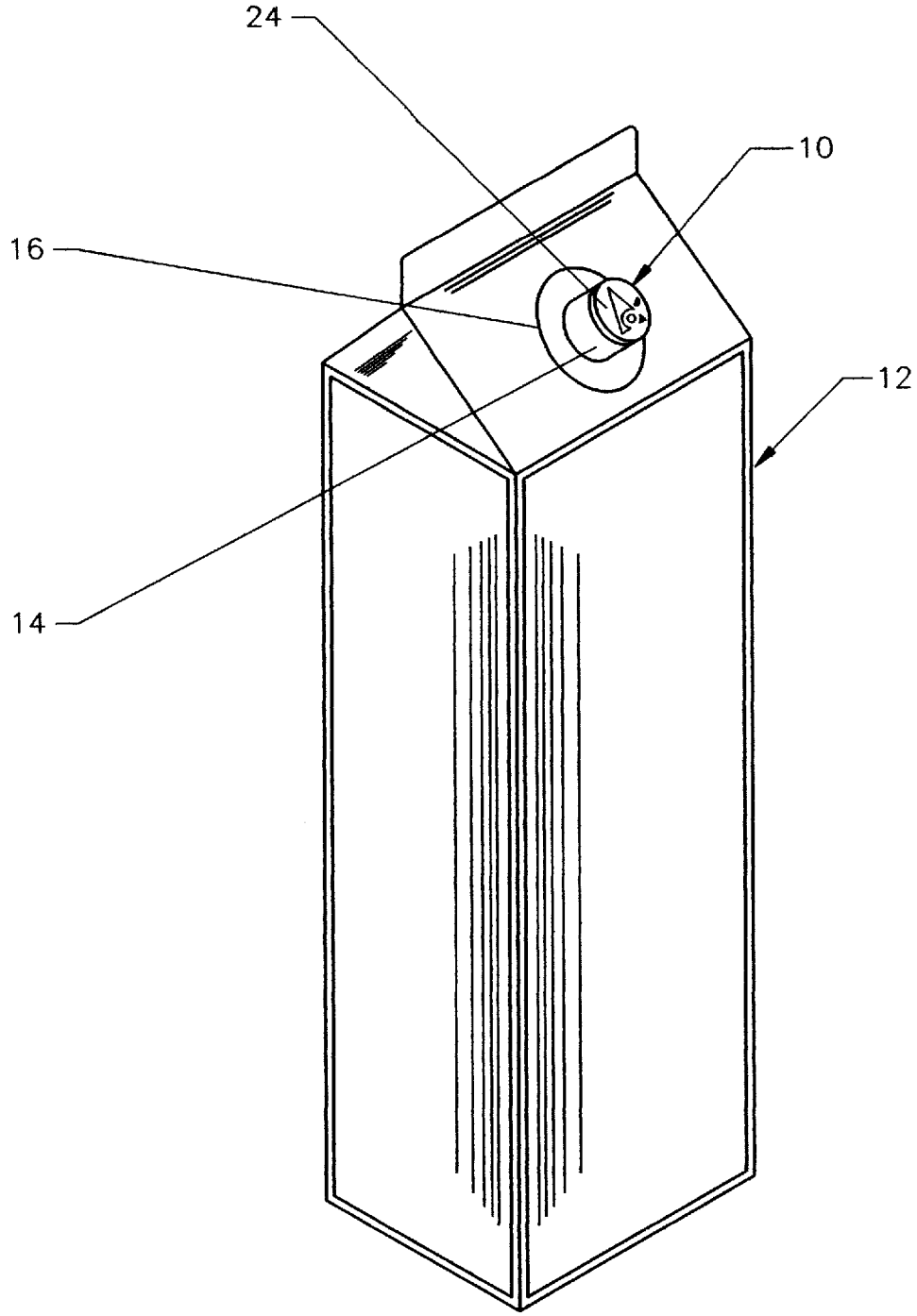
FIG. 1 is a perspective view of a container, specifically, a gable top carton having a directionally or orientationally sensitive closure mounted thereto, the illustrated closure being configured in accordance with the principles of the present invention.
Figure 2:
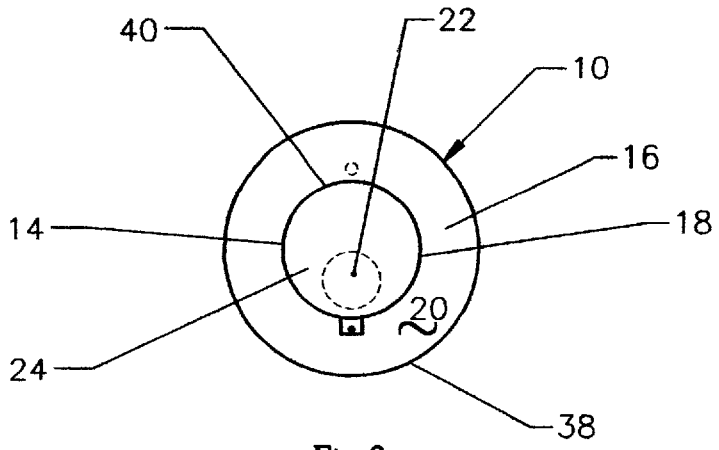
FIG. 2 is top view of an exemplary closure embodying the principles of the present invention, the closure being illustrated with a dispensing opening therein shown in a phantom line.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures, and in particular to FIGS. 1–4, there is shown an embodiment of an orientationally or directionally sensitive closure 10. The closure 10 is shown, in FIG. 1, mounted to an exemplary gable top carton type container 12. The exemplary closure 10 is a hinged-type closure, and includes a body 14 having a flange 16 extending therefrom. The flange 16 is configured for mounting the closure 10 to the container 12. The closure body 14 includes a spout 18 that extends upwardly from one side 20 of the flange 16. In a current embodiment, the flange 16 and spout 18 are coaxial with one another about an axis as indicated at 22.

In the illustrated closure 10, a cover 24 is operably connected to the body 14 by a hinge 26. The hinge 26 can include one or more flexible elements 28 extending between the cover portion 24 and the closure body 14. It will be recognized that the hinged cover 24 can open in only one direction. That is, the cover 24 pivots about a particular hinge axis H. Thus, the closure 10 and cover 24 are orientationally or directionally sensitive.

Although a hinged cover 24 is shown, it will be recognized by those skilled in the art that other types of directionally sensitive covers and operating mechanisms, such as finger depressible, rocker-type valves can be used. Such other types of operating mechanisms and covers are within the scope of the present invention.

Figure 3:
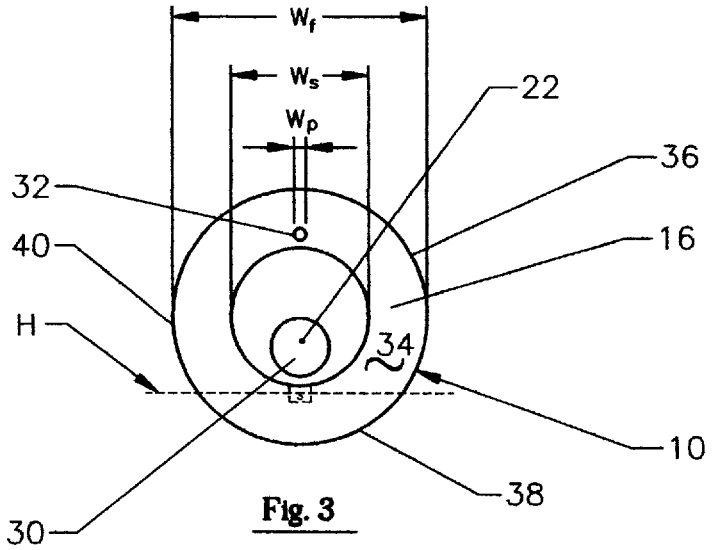
FIG. 3 is a bottom view of the closure of FIG. 2.
Figure 4:
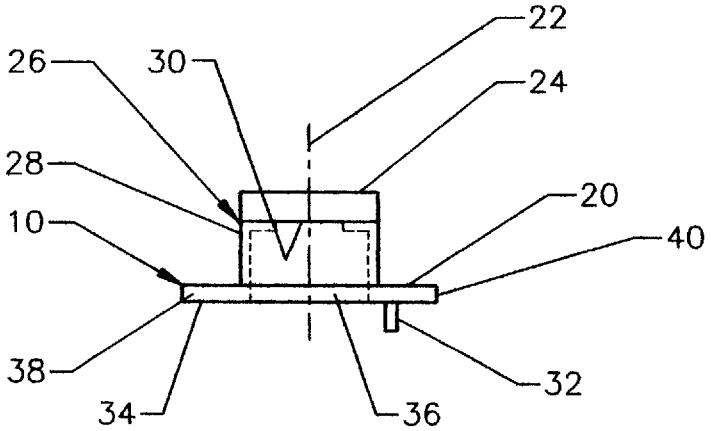
FIG. 4 is a side view of the closure of FIG. 2, as viewed from the right-hand side thereof.

The closure body 14 includes an opening 30 therein through which the contents of the container 12 are dispensed when the closure 10 is mounted to the container 12. As best seen in FIGS. 3 and 4, the closure 10 includes an orienting projection 32 extending from the flange 16 from a side 34 opposite of the spout side 20. The orienting projection 32 can be formed as a relatively small post or post-like element extending from the flange side 34. The projection 32 can be formed as a relatively short, barrel-like element having a circular cross-section. The projection 32 extends from the flange 16 in a non-coaxial relation thereto, that is, the projection 32 extends from the flange 16 in spaced relation to the axis 22.

The portion of the peripheral edge 36 of the flange 16 farthest from the projection 32, as indicated by the arrow at 38, defines a leading edge of the closure 10. Conversely, a trailing edge 40 of the of the flange 16 is that point on the peripheral edge 36 of the flange 16 closest to the projection 32, as indicated by the arrow at 40. It will be readily apparent from FIGS. 2–4 that the leading and trailing edges 38, 40, respectively of the closure 10 are diametrically opposed to one another, i.e., 180° relative to one another.

It will also be readily apparent from the figures that the flange 16, spout portion 18 and orienting projection 32 each have a width, the respective widths being configured relative to widths of the other of the closure 10 parts. In a current embodiment, the flange 16 is the widest of the closure 10 parts having a width $W_f$. The spout 18 width $W_s$ is less than the width $W_f$ of the flange 16 and greater than the projection 32 width $W_p$.

Figure 5:
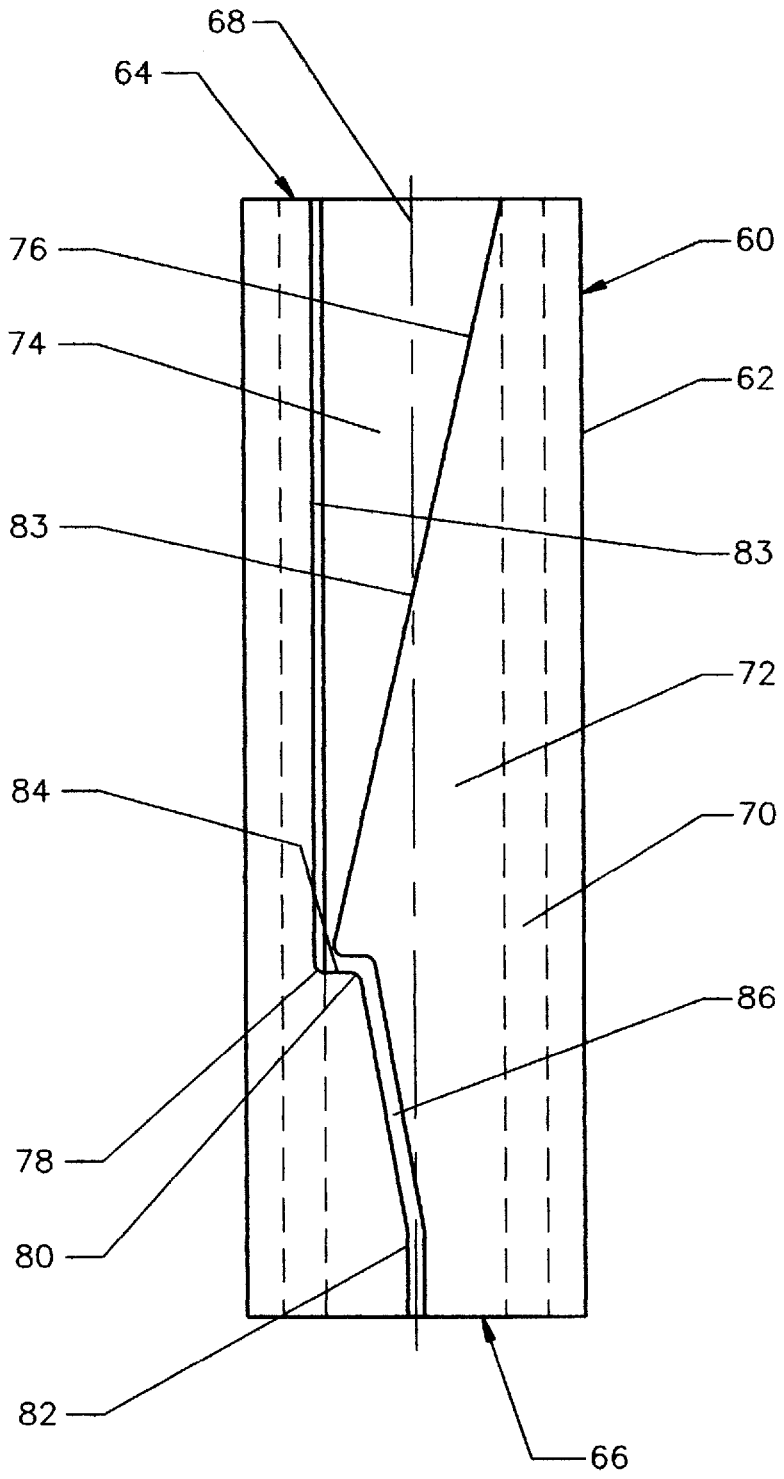
FIG. 5 is a front view of an embodiment of an orienting apparatus in accordance with the principles of the present invention, the apparatus being illustrated with the first and second, i.e., the spout and flange channels shown, in part, in phantom lines.
Figure 6:
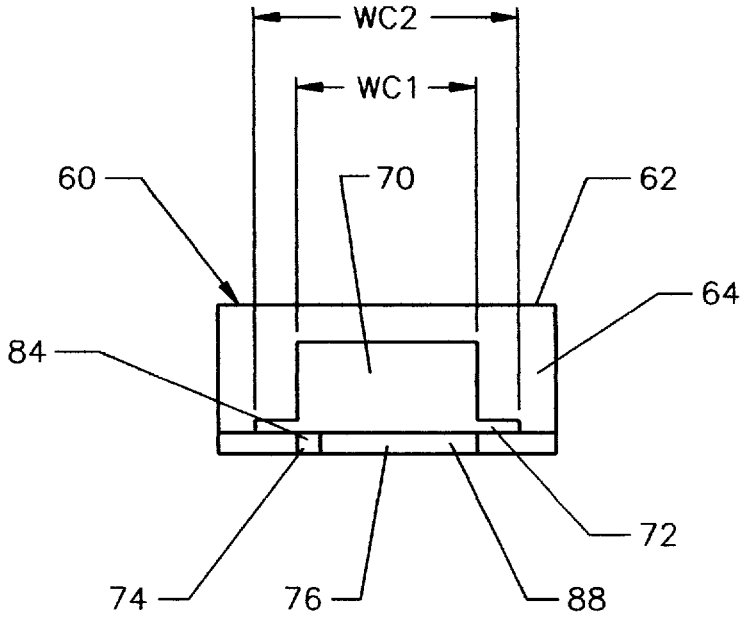
FIG. 6 is a top view of the orienting apparatus of FIG. 5.

One embodiment of an apparatus 60 for orienting the closures 10 is illustrated in FIGS. 5–7. The apparatus 60 is a gravity feed type device that uses gravity acting on the closures 10 as the motive force for moving the closures 10 through the apparatus 60 and orienting the closures 10 as they traverse through and exit therefrom. The orienting apparatus 60 includes a body portion 62 having an inlet region 64 and an outlet region 66. The body 62 defines a longitudinal axis, as indicated at 68, between the inlet 64 and outlet 66 regions. First, second and third receiving channels, 70, 72 and 74, respectively, are formed in the body 62 extending between the inlet and outlet regions 64, 66. The channels 70, 72 and 74 are configured to slidingly receive the spout 18, flange 16 and orienting projection 32, respectively.

The first and second channels 70, 72, i.e., the spout and flange channels, traverse through the body 62 defining relatively straight-through paths between the inlet and outlet regions 64, 66. As best seen in FIG. 6, each the first and second channels 70, 72 have substantially constant cross-sectional areas and substantially constant widths. The width of each the first and second channels $W_{c1}$ and $W_{c2}$ is somewhat greater than the width of its corresponding closure part (i.e., the first channel width $W_{c1}$ is somewhat greater than the spout width $W_s$, and the second channel width $W_2$ is somewhat greater than the flange width $W_f$), to permit the closure 10 to freely slide or traverse through the apparatus 60.

As best seen in FIG. 5, the third channel 74, i.e., the orienting projection channel, has a path that includes an inward taper from the inlet region 64, as indicated at 76, and a plurality of bends, preferably, two bends, as indicated at 78 and 80, respectively, between the inlet and outlet regions 64, 66. In an embodiment in which the channel 74 includes two bends, the bends 78, 80 have angles of about 90° and 80°, respectively. The channel 74 can include one or more additional bends, such as the exemplary third bend 82, to discharge the closures 10 in a path parallel to the longitudinal axis 68.

A diagrammatic illustration of a closure 10 traversing through the orienting apparatus 60 is shown in FIGS. 7*a–e*. It will be readily apparent from the figures and the present description that the closure 10 will exit or will be discharged from the orienting apparatus 60 with the leading edge 38 first exiting (in a leading position) the apparatus 60 and the trailing edge 40 last exiting (in a trailing position) the apparatus 60. It is to be noted that the apparatus 60 is oriented with the longitudinal axis 68 positioned in a vertical or near vertical orientation. In a current embodiment, the longitudinal axis 68 is positioned between a vertical orientation and about 30° from the vertical.

Figure 7A:
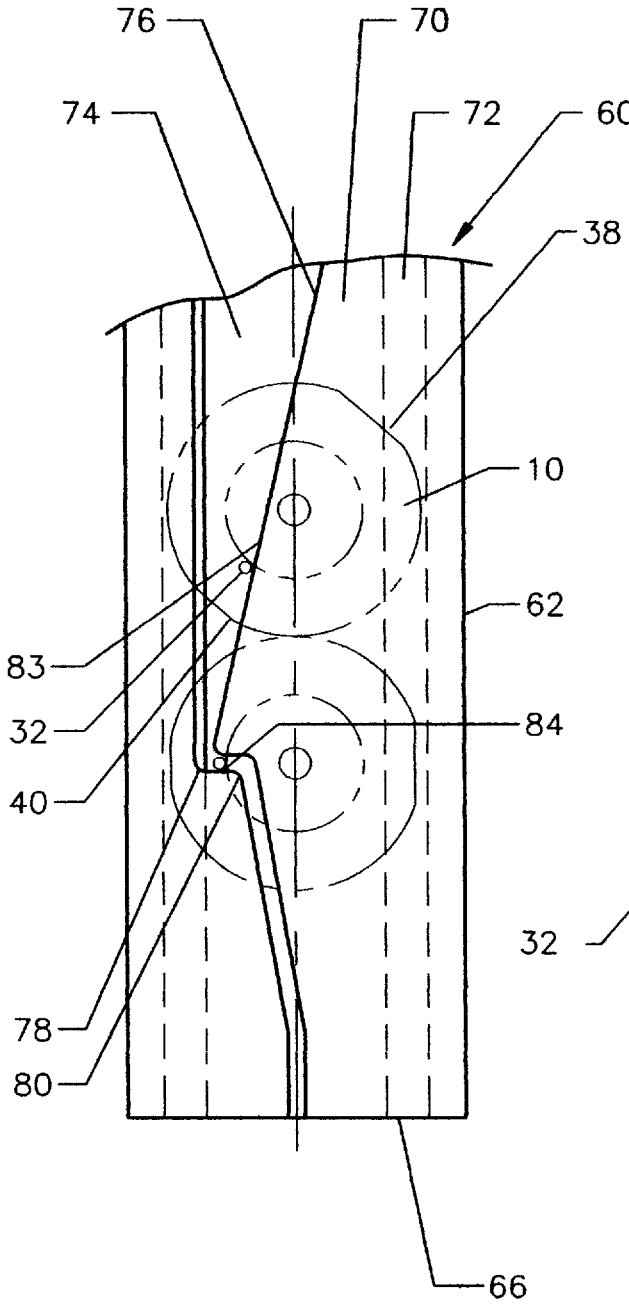
FIGS. 7*a–e* diagrammatically illustrate a directionally sensitive closure as it traverses through the orienting apparatus of FIG. 5, the closure being shown entering the apparatus with the trailing edge in a near leading position, and exiting the apparatus with the leading edge in a leading position.

FIG. 7*a* shows a closure 10 as it traverses through the apparatus 60. The spout 18 is positioned within the spout channel 70, the flange 16 is positioned within the flange channel 72 and the orienting projection 32 is positioned within the projection channel 74. The closure 10 is illustrated with the trailing edge 40 or a trailing portion of the closure 10 in a leading position. As the closure 10 moves downward in the apparatus 60, the projection 32 can contact one of the sides 83 of the channel 74. The resistance generated by contact between the projection 32 and a channel side 83 begins to rotate the closure 10 so that the projection 32 shifts to a trailing position. That is, the leading edge 38 will begin to rotate into a leading position as the closure 10 moves toward the outlet region 66.

Figure 7B:
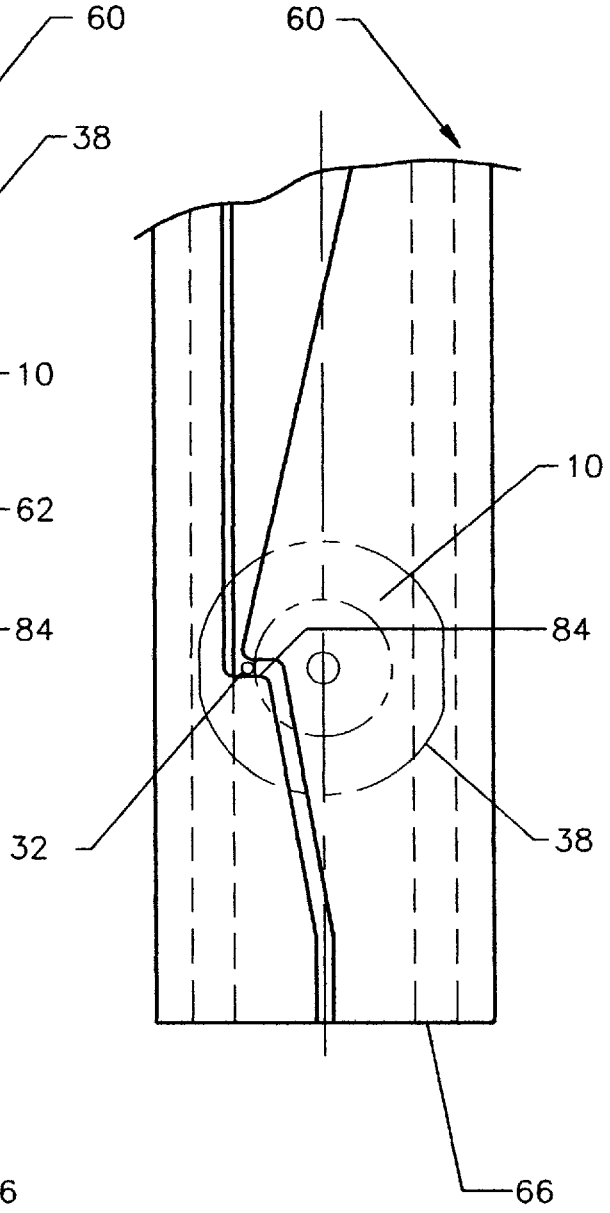

Referring to FIG. 7*b*, as the closure 10 traverses further into the apparatus 60, the projection 32 is directed against a wall 84 that is defined by the first bend 78 in the projection channel 74. Gravity acting on the closure 10, and more particularly, gravity acting on the center of gravity of the closure 10 (which for purposes of the present discussion is assumed to be at about the center of the closure 10) further rotates the closure 10 as it pivots about the projection 32 which is contacting the wall 84.

Figure 7C:
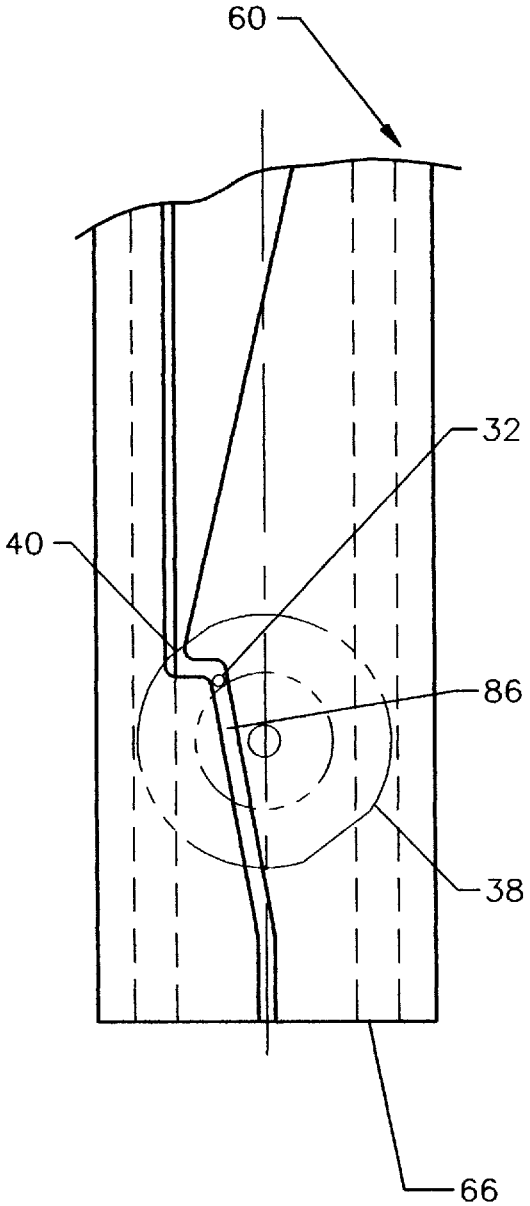

As shown in FIG. 7*c*, the closure 10 continues to rotate which moves the projection 32 off of the wall 84, around the second bend 80, and into a vertical or near vertical portion 86 of the projection channel 74. The continued rotation of the closure 10 is due to gravitational forces acting on the closure 10 as the projection 32 contacts or drags against the sides 83 of the channel 74.

Figure 7D:
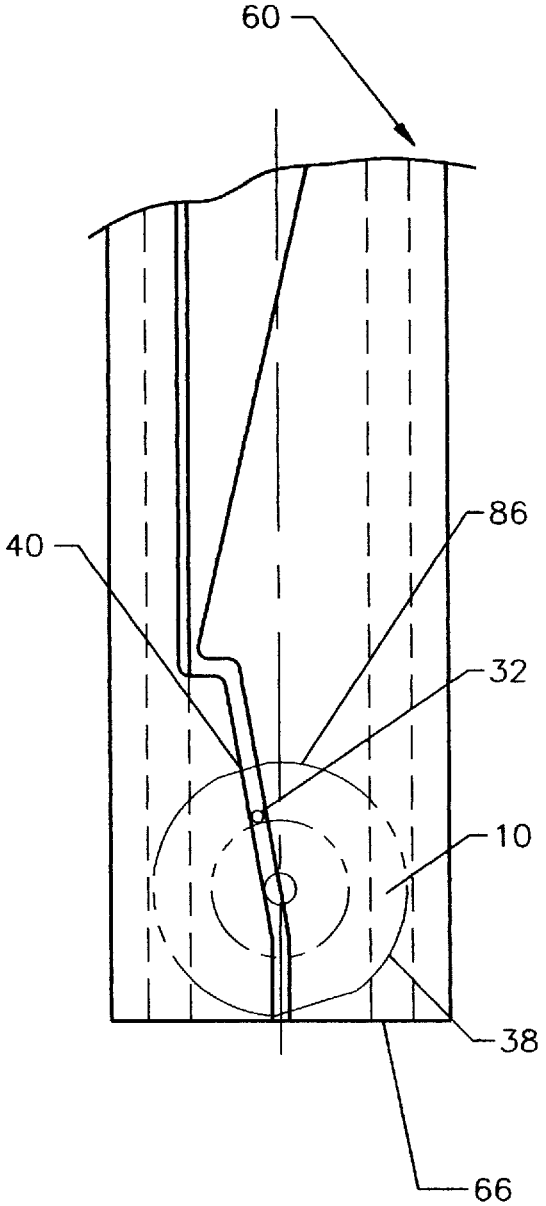
Figure 7E:
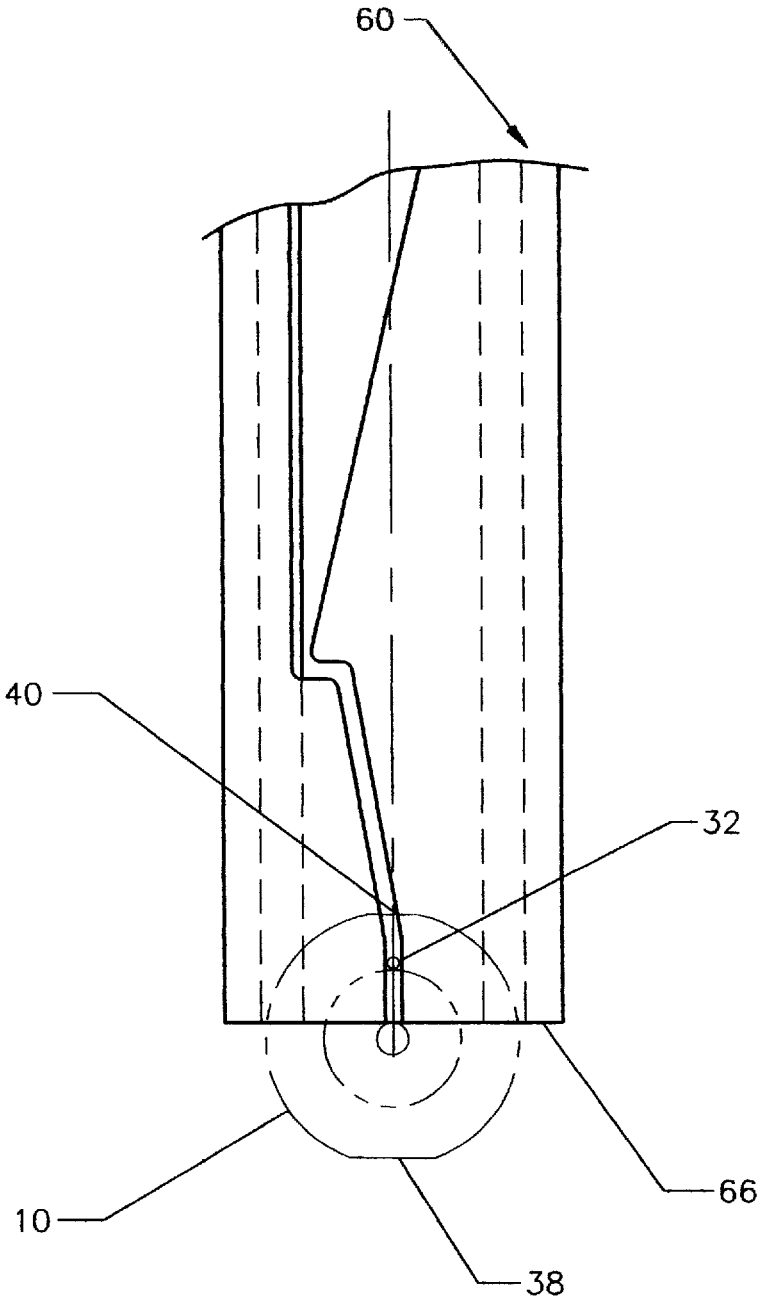

At this point, as shown in FIGS. 7*d–e*, the closure 10 has been rotated so that it is oriented with the leading edge 38 in the leading position and the trailing edge 40 in the trailing position. It is important to note that the channel 70, 72 widths $W_{c1}$ and $W_{c2}$ are accordingly proportioned so that once the closure 10 passes the second bend 80 it cannot continue rotating so as to pass beyond the desired leading edge orientation to permit the trailing edge to lead. The closure 10 then exits or is discharged from the apparatus 60 properly oriented, with the leading edge 38 first exiting the apparatus 60, i.e., with the leading edge 38 in a leading position.

It will be apparent from the figures that when a closure 10 enters the apparatus 60 with the leading edge 38 in a leading position, the above discussion applies, however, the extent of rotation of the closure 10 will be less than it is with the closure 10 entering the apparatus 60 by the trailing edge 40.

Figure 8:
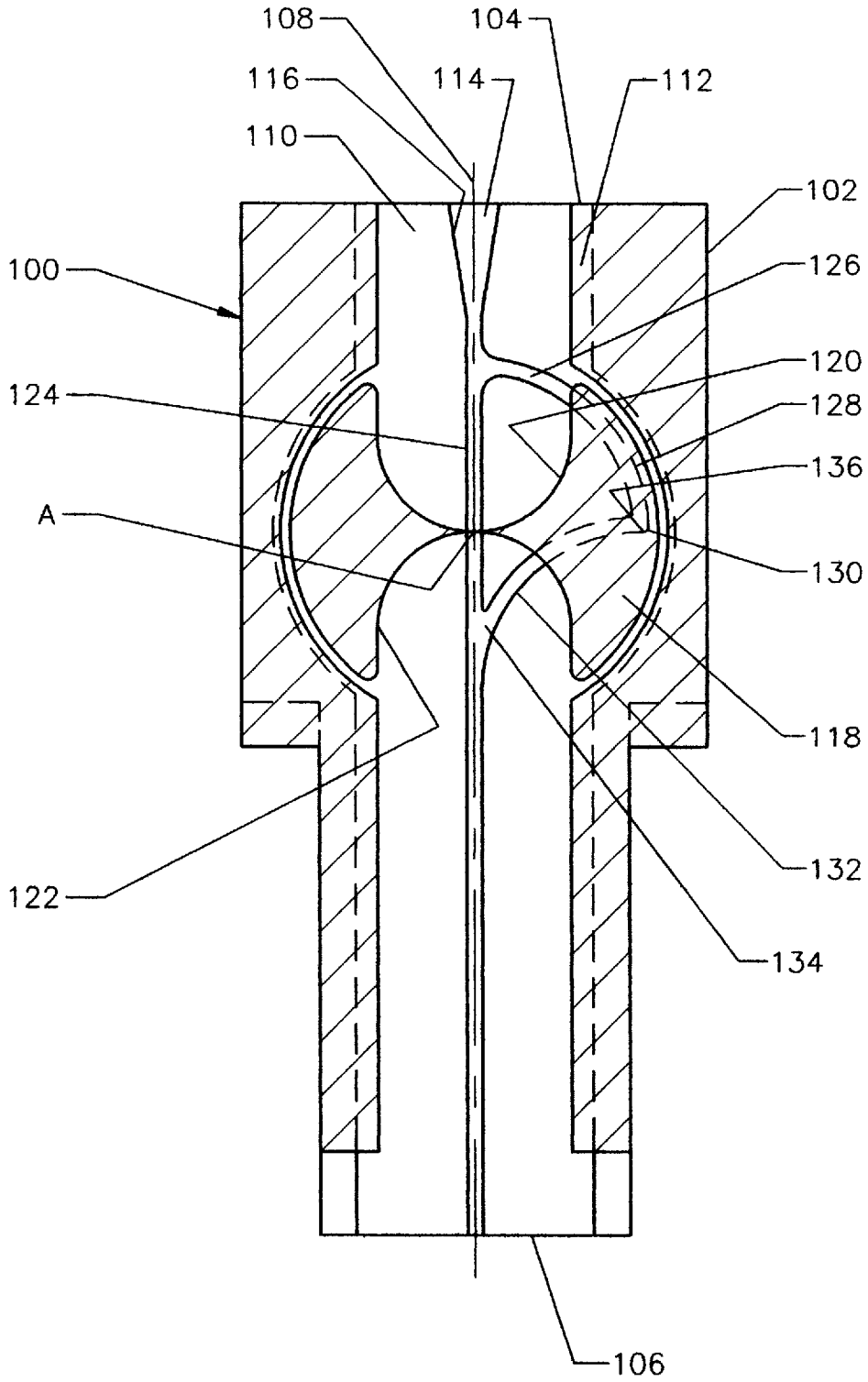
FIG. 8 is a front view of an alternate embodiment of a closure orienting apparatus in accordance with the principles of the present invention.

An alternate embodiment 100 of the orienting apparatus is illustrated in FIGS. 8–9. The orienting apparatus 100 includes a main body 102 having an inlet region 104 and an outlet region 106. The body defines a longitudinal axis, as indicated at 108, that extends between the inlet and outlet regions 104, 106. First, second and third receiving channels 110, 112 and 114, respectively, are formed in the body 102 extending between the inlet and outlet regions 104, 106. The channels 110, 112 and 114 are adapted to slidingly receive the spout 18, flange 16 and orienting projection 32, respectively. The third channel 114, i.e., the projection channel, can be configured with a tapered inlet, as indicated at 116, to facilitate introducing the closures 10 to the apparatus 100.

The orienting apparatus 100 includes a rotating cylinder 118 positioned on the body 102, in the path of travel of the closures 10, intermediate the inlet and outlet regions 104, 106. The cylinder 118 rotates about an axis A, and includes at least one, and preferably two, opposingly oriented, semicircular cradle regions 120, 122 that are symmetrically positioned about the axis A. The cradle regions 120, 122 are configured to receive closures 10, at about the spout 18, and transport the closure 180° from the inlet region 104 to the outlet region 106. The cylinder 118 is positioned in the path of, and intersecting, the first and second channels, 110, 112 i.e., the spout and flange channels, and is positioned, as illustrated in FIG. 8, above the third channel 114, i.e., projection channel.

The first and second channels 110, 112 each define an essentially straight-through path except for the rotational movement by and about the cylinder 118 as will be described herein. The third channel 114 has a pair of branches 124, 126. The first branch 124 has a straight-through path. The second branch 126 follows a diverging-converging path, and diverges outwardly, arcuately from the first path at about a periphery of the cylinder, as indicated at 128. The diverging portion 128 of the path extends a distance about equal to a 90° rotation of the cylinder 118. The diverging path 128 transitions as indicated at 130, reversing direction, to an inwardly, arcuately extending path 132 that converges with the straight-through. The converging portion 132 of the path conjoins with the straight-through path 124, as indicated at 134, at a distance about equal to a 90° rotation of the cylinder 118.

Essentially, the third channel 114 has a two paths, a straight-through path 124 and an arcuate path 126. The arcuate path 126 has an outwardly, arcuately diverging portion 128 that transitions, as indicated at 130, to an inwardly, arcuately converging portion 132, that conjoins, as indicated at 134, with the straight-through path 124.

In operation, similar to the first embodiment 60, with reference now to FIGS. 9*a–d*, the orienting apparatus 100 is configured to slidingly receive a closure 10 with the projection 32 extending into the third channel 114, and to reorient the closure 10 such that the closure 10 exits or is discharged from the apparatus 100 with the leading edge 38 exiting the apparatus 100 in a leading position.

Figure 9A:
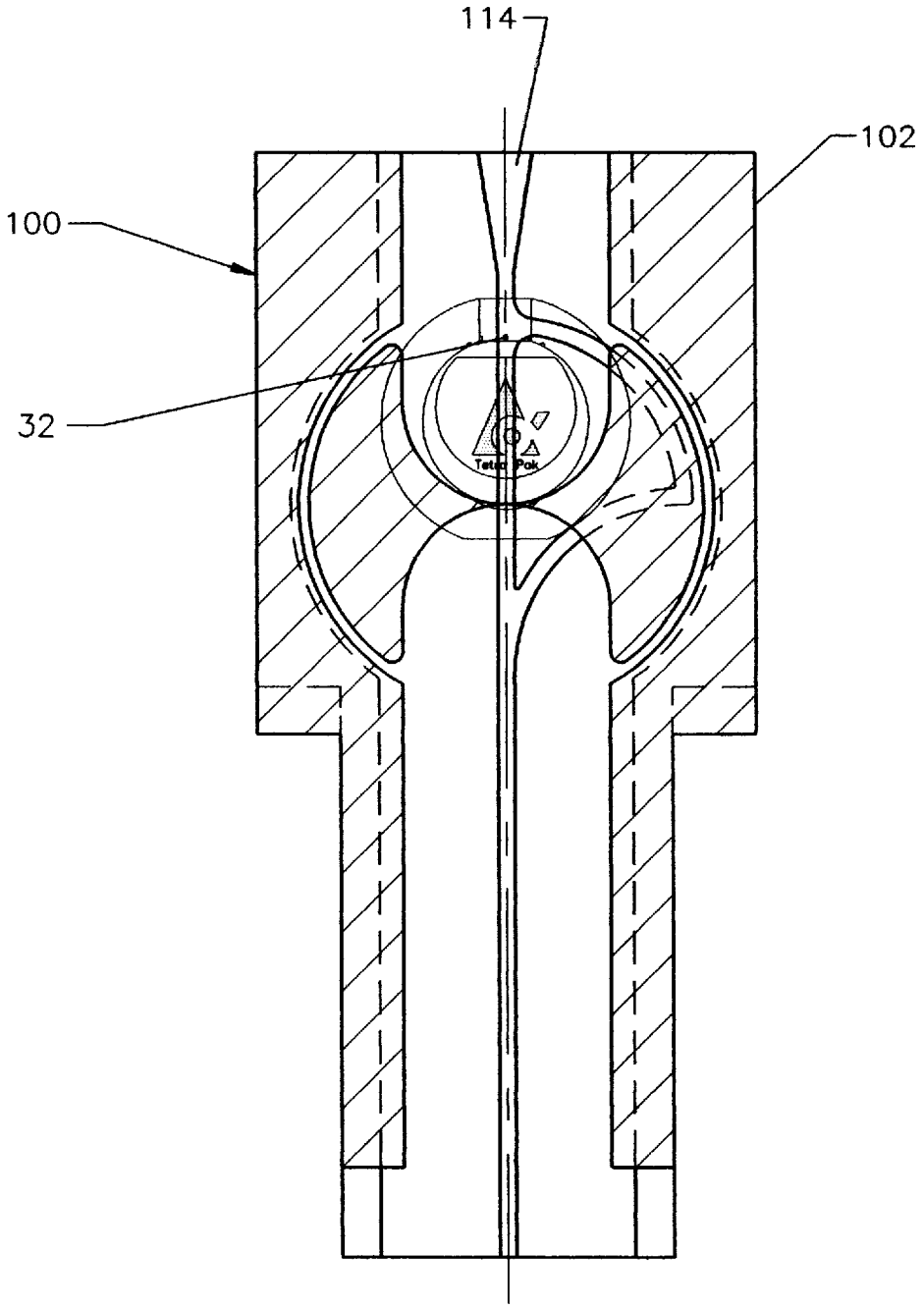
FIGS. 9*a–d* diagrammatically illustrate a directionally sensitive closure as it traverses through the orienting apparatus of FIG. 8, the closure being shown entering the apparatus with the leading edge in a near leading position, and exiting the apparatus with the leading edge in a leading position.

The operation of the apparatus 100 will be first described with a closure 10 entering the apparatus 100 with the projection 32 (i.e., the trailing edge 40) in a trailing position. As shown in FIG. 9*a*, the closure 10 is presented to the inlet region 104 of the apparatus 100. The tapered inlet 116 of the channel 114 directs the closure 10 such that the leading edge 38 of the closure 10 first enters the cylinder 118 and the spout 18 rests in the cradle 120. As best seen in FIG. 9*a*, the projection 32 is at the point of divergence of the third channel 114. As the cylinder 118 rotates clock-wise, the closure 10 remains stationary relative to the cradle 120, but rotates clock-wise with the rotating cradle 120. As the closure 10 rotates, the projection 32 moves along the diverging path 128, as illustrated in FIG. 9*b*.

Figure 9B:
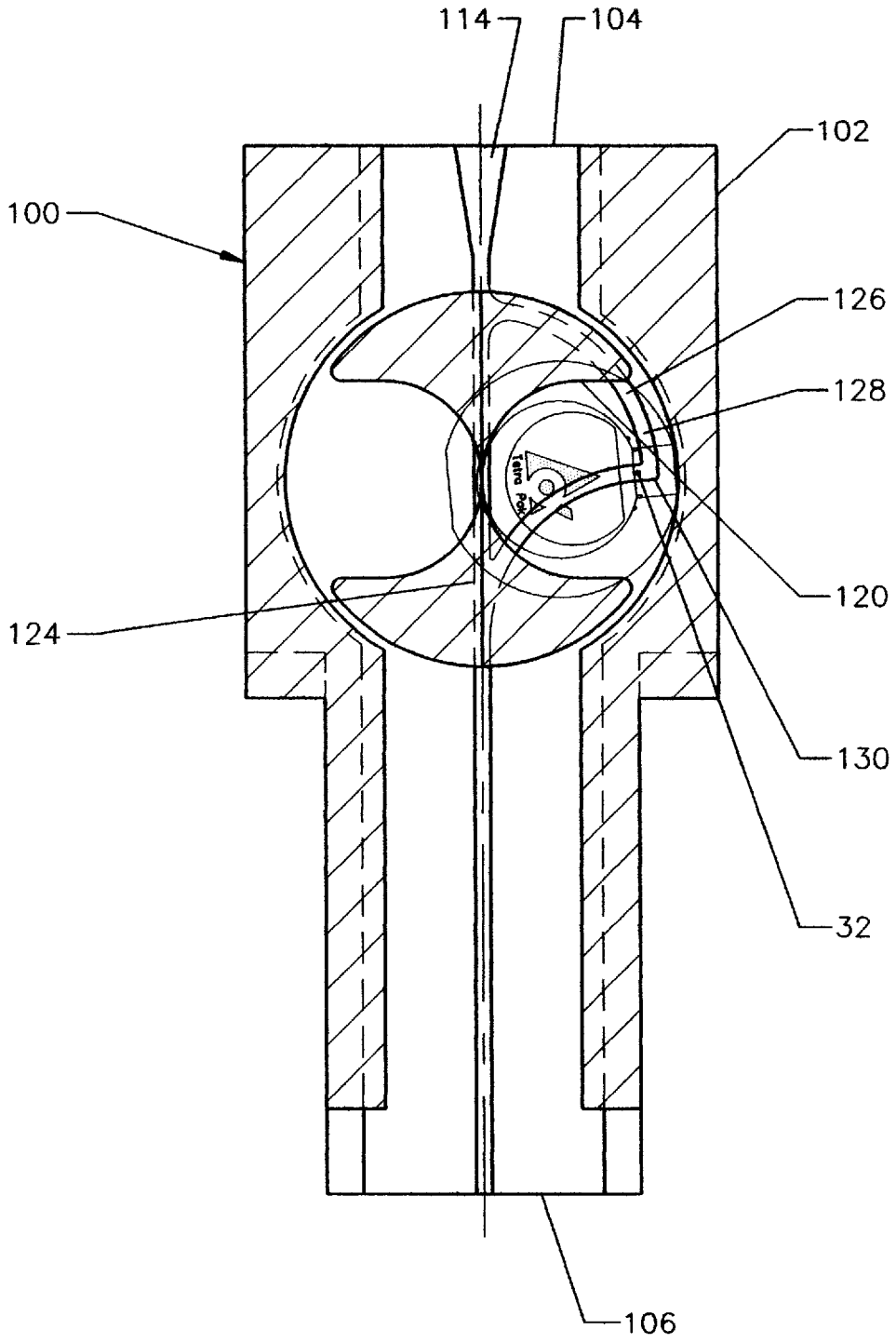
Figure 9C:
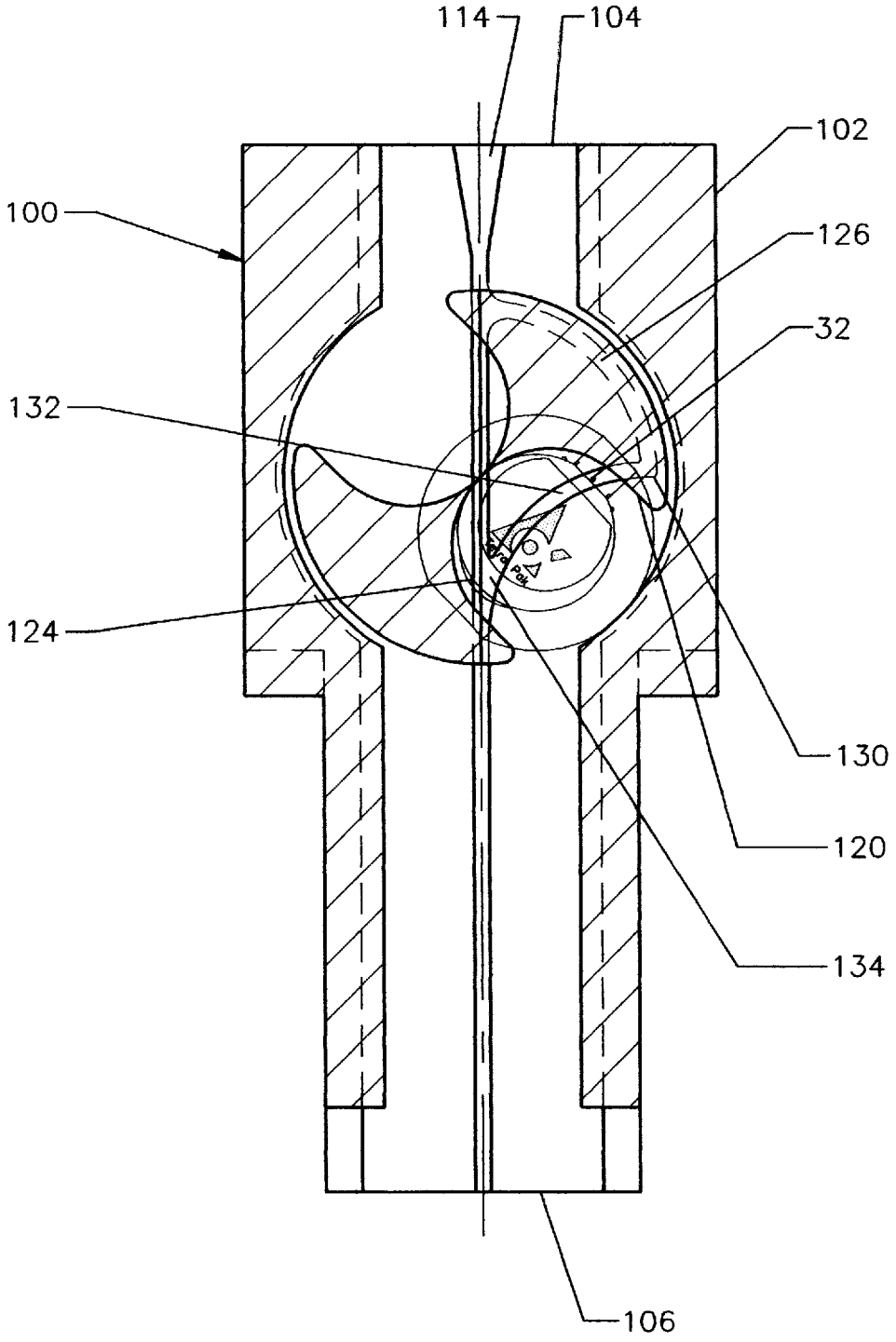
Figure 9D:
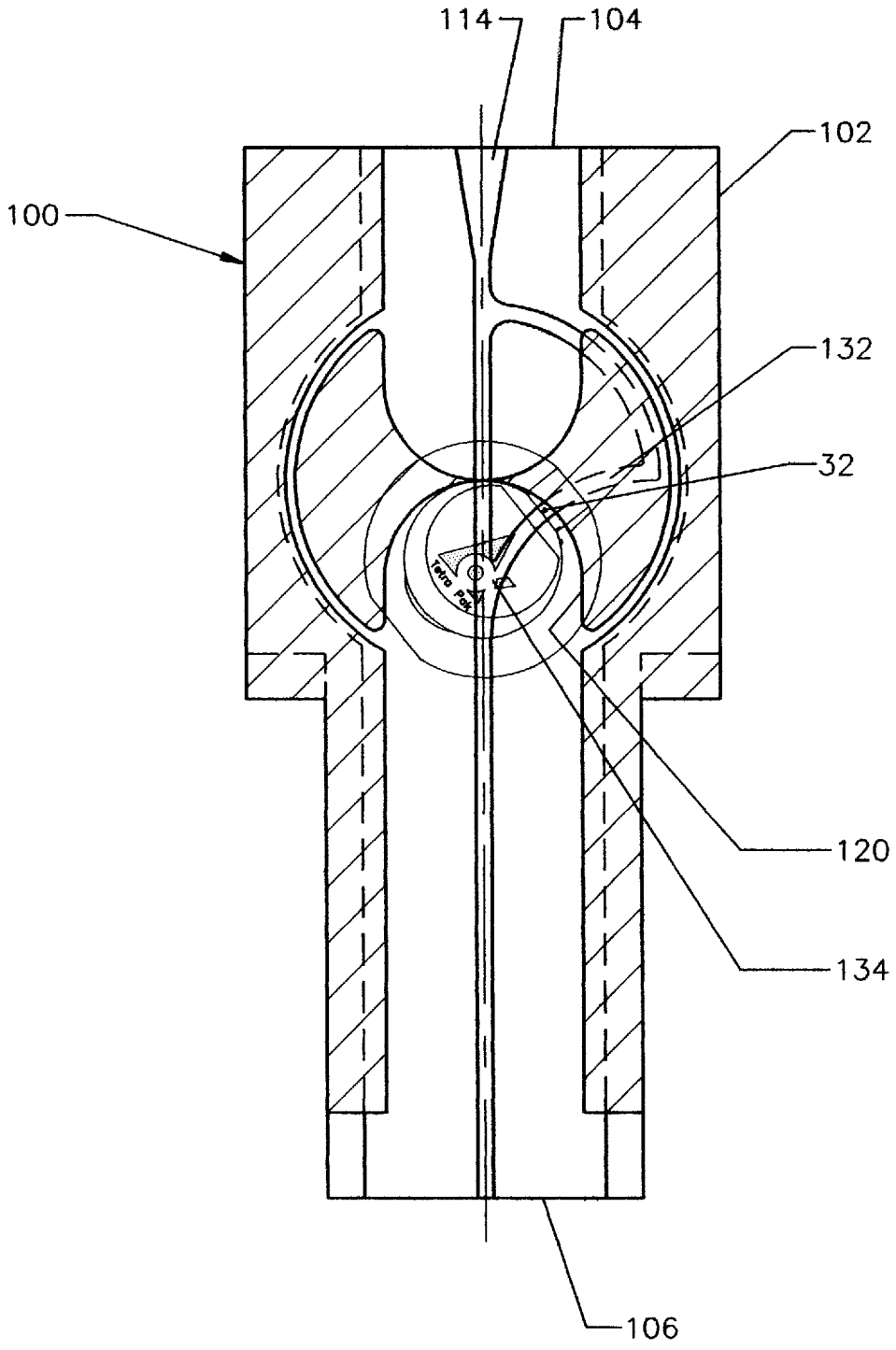

As this point, as shown in FIG. 9*b*, the projection 32 is resting against the channel wall at the transition 130. As the cylinder 118 further rotates clock-wise, the projection 32 is urged along the converging path 132, and the closure 10 rotates counter clock-wise as shown in FIG. 9*c*, relative to, and as the cradle 120 rotates. As the cradle 120 comes into alignment with the outlet region 106, the projection 32 is oriented rearward with the leading edge 38 of the closure 10 directed toward the outlet region 106. As the closure 10 exits from the apparatus 100, the leading edge 38 is first discharged therefrom.

Figure 10:
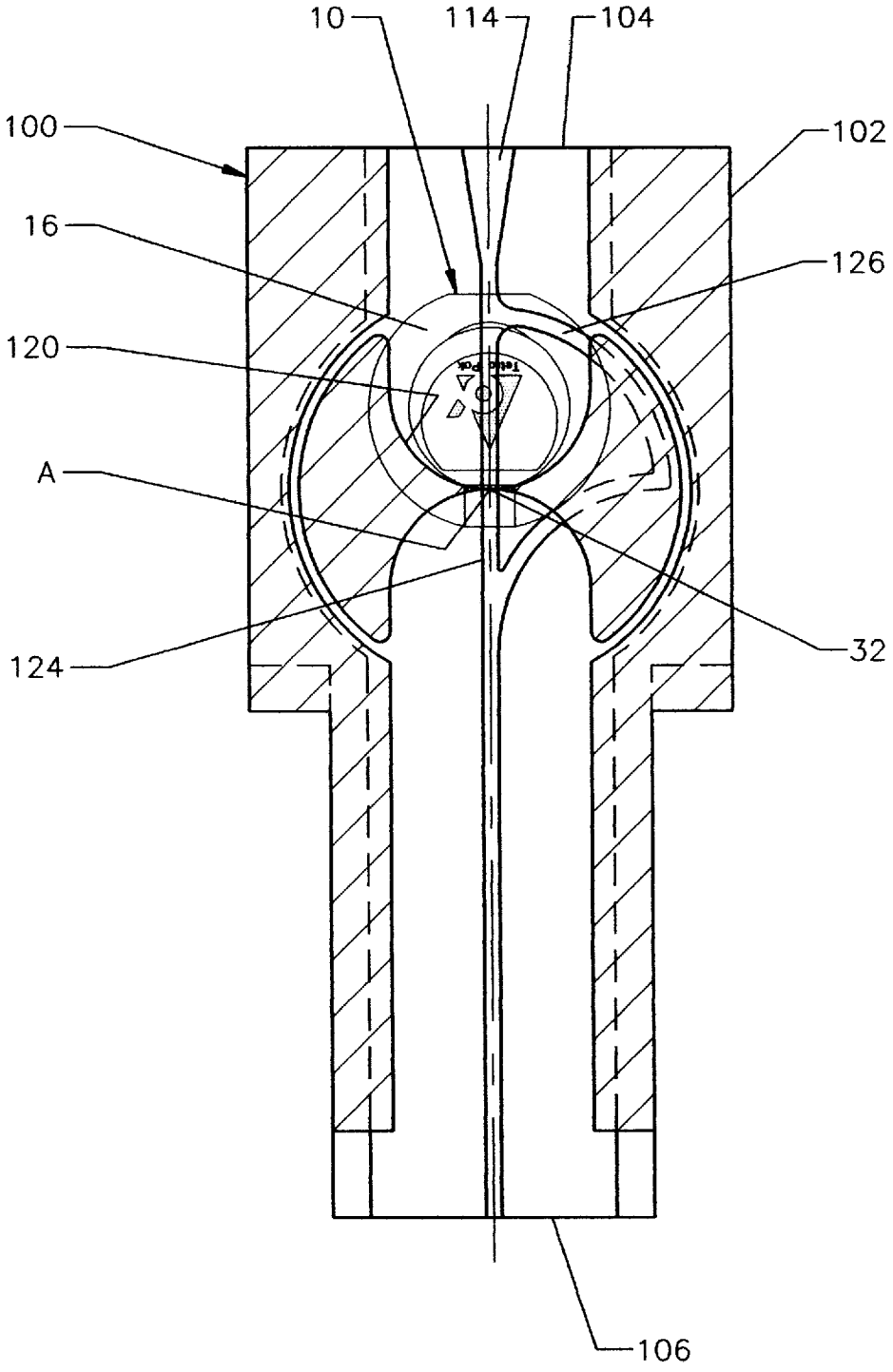
FIG. 10 diagrammatically illustrates the closure and apparatus of FIGS. 8–9 showing the closure having entered the apparatus with the trailing edge in a near leading position, and resting in the apparatus cradle.

FIG. 10 illustrates the apparatus 100 of FIG. 8, with a closure 10 entering the apparatus 100 with the trailing edge 40 in a leading position. The closure 10 is presented to the apparatus 100 and traverses downward to position the spout 18 in the cradle 120. In this position, the projection 32 is collinear with the axis A. As the cradle 120 rotates, the projection 32 is held in place in the straight-through portion 124 of the third channel 114 and serves as a pivot for the closure 10. As the cradle 120 rotates, the closure 10 rotates about 180° with the cradle 120, about the projection 32. The closure 10 is then discharged from the cradle 120 and the apparatus 100 with the leading edge 38 first discharged therefrom, i.e., with the leading edge 38 in a leading position.

Advantageously, the orienting apparatus 100 also singulates the closures 10. That is, the closures 10 are individually discharged from the apparatus 100 so that the closure 10 units are ready for further processing and mounting to a container 12. Similar to the first embodiment 60, the apparatus 100 is intended to be oriented in a vertical or near vertical orientation to permit maximum use of gravity to effect traversing the closures 10 through the apparatus 100. It will be recognized by those skilled in the art that although the present apparatus is illustrated with a pair of symmetrical cradle regions 120, 122, numerous variations and changes can be made to the apparatus 100 without departing from the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An apparatus for orienting a closure for mounting to an associated container, the closure having a flange having a spout extending from a side thereof centrally positioned on and coaxial with the flange, and an orienting projection extending from an opposite side of the flange in non-coaxial relation to the flange and spout, the flange having a width and the spout having a smaller width than the flange width, the closure defining a trailing edge at a peripheral portion of the flange closest to the orienting projection, the apparatus comprising:

a body portion having an inlet region and an outlet region extending along a longitudinal axis thereof, the body defining longitudinally oriented first, second and third receiving channels extending from the inlet region to the discharge region, the first receiving channel having a width configured to accommodate and slidingly receive the closure spout, the second receiving channel having a width configured to accommodate and slidingly receive the closure flange, the third receiving channel having a width configured to accommodate and slidingly receive the closure orienting projection, the third receiving channel having at least two bends therein defining a portion of the channel extending generally transverse to the longitudinal axis, wherein the closure, positioned at the inlet region and traversing through the apparatus is rotationally oriented by interaction of the orienting projection and the third channel to discharge the closure by the trailing edge last.

2. The apparatus for orienting a closure in accordance with claim 1 wherein each the first and second receiving channels have a substantially constant cross-sectional area.

3. The apparatus for orienting a closure in accordance with claim 1 wherein the third receiving channel has three bends defining a portion generally transverse to the longitudinal axis, the third channel being configured to discharge closures therefrom in a direction parallel to the longitudinal axis.

4. The apparatus for orienting a closure in accordance with claim 1 wherein the third receiving channel has in inward taper.

5. The apparatus for orienting a closure in accordance with claim 1 wherein the first channel extends in a generally straight-through path along the longitudinal axis.

6. The apparatus for orienting a closure in accordance with claim 1 wherein the second channel extends in a generally straight-through path along the longitudinal axis.

7. An apparatus for orienting a closure for mounting to an associated container, the closure having a flange having a spout extending from a side thereof centrally positioned on and coaxial with the flange, and an orienting projection extending from an opposite side of the flange in non-coaxial relation to the flange and spout, the flange having a width and the spout having a smaller width than the flange width, the closure defining a trailing edge at a peripheral portion of the flange closest to the orienting projection, the apparatus comprising:

a body portion having an inlet region and an outlet region extending along a longitudinal axis thereof, the body defining a longitudinally oriented flange receiving channel having a width adapted to slidingly receive the closure flange and a projection receiving channel extending generally longitudinally along the body portion and having a width adapted to slidingly receive the closure orienting projection, the projection receiving channel having at least two bends therein defining a portion extending generally transverse, in part, relative to the longitudinal axis, wherein the closure, positioned at the inlet region and traversing through the apparatus is rotationally oriented by interaction of the orienting projection and the projection channel to discharge the closure by the trailing edge last.

8. The apparatus for orienting a closure in accordance with claim 7 including a cylinder positioned on the body intermediate the inlet and outlet regions, the cylinder being rotatable about an axis and configured to receive a portion of the closure therein as the closure traverses through the inlet region and rotate about 180° carrying the closure therewith to discharge the closure therefrom into the outlet region, the cylinder configured to permit rotation of the closure relative thereto and to urge the projection through the projection channel, wherein the closure traversing through the apparatus is rotationally oriented by rotation of the cylinder and interaction of the orienting projection and the projection channel to discharge the closure by the trailing edge last.

9. The apparatus for orienting a closure in accordance with claim 8 wherein the cylinder has at least one cradle region formed therein adapted to receive the closure.

10. The apparatus for orienting a closure in accordance with claim 9 wherein the at least one cradle region is adapted to receive the closure at about the spout.

11. The apparatus for orienting a closure in accordance with claim 9 wherein the cylinder has two symmetrically positioned cradle regions positioned about the axis and oriented 180° relative to one another.

12. The apparatus for orienting a closure in accordance with claim 8 wherein the projection channel has a pair of branches, a first branch defining a relatively straight-through path extending between the inlet and outlet regions, and a second branch defining an outwardly extending portion and an inwardly extending portion contiguous therewith, each the outwardly extending portion and inwardly extending portion being contiguous with the straight-through branch.

13. The apparatus for orienting a closure in accordance with claim 12 wherein the outwardly extending portion extends from the straight-through branch at about the inlet region and has an outwardly, arcuately extending path that transitions to the inwardly extending portion, the inwardly extending portion having an inwardly, arcuately extending path that conjoins with the straight-through branch at about the outlet region.

14. The apparatus for orienting a closure in accordance with claim 7 including a spout receiving channel.

15. The apparatus for orienting a closure in accordance with claim 7 wherein the projection receiving channel defines an inward taper at about the inlet region.

* * * * *